US006585279B1

(12) United States Patent
Galloway et al.

(10) Patent No.: US 6,585,279 B1
(45) Date of Patent: Jul. 1, 2003

(54) LEG EXTENSION ASSEMBLY

(75) Inventors: Robert Galloway, Kellerton, IA (US); Phic Lovan, Des Moines, IA (US)

(73) Assignee: Medical Industries America, Inc., Adel, IA (US)

( * ) Notice: Subject to any disclaimer, the term of this patent is extended or adjusted under 35 U.S.C. 154(b) by 0 days.

(21) Appl. No.: 09/969,216

(22) Filed: Oct. 2, 2001

(51) Int. Cl.[7] ..... A47C 7/50

(52) U.S. Cl. ..... 280/304.1; 297/423.23; 297/423.3

(58) Field of Search ..... 280/250.1, 304.1; 180/907; 297/423.2, 423.22, 423.23, 423.24, 423.26, 423.29, 423.19, 423.3, DIG. 4

(56) References Cited

U.S. PATENT DOCUMENTS

| | | | | |
|---|---|---|---|---|
| 156,004 | A | * | 10/1874 | Wayland |
| 2,145,037 | A | | 1/1939 | Bennett |
| 2,481,970 | A | | 9/1949 | Bell |
| 2,746,520 | A | | 5/1956 | Ducrot |
| 2,852,883 | A | | 9/1958 | Walsh |
| 3,191,990 | A | | 6/1965 | Rugg et al. |
| 3,284,126 | A | * | 11/1966 | Piazza |
| 3,495,869 | A | * | 2/1970 | Ingemansson |
| 3,858,938 | A | | 1/1975 | Kristensson |
| 4,949,408 | A | | 8/1990 | Trkla |
| 5,033,793 | A | | 7/1991 | Quintile |
| 5,094,508 | A | | 3/1992 | Bathrick et al. |
| 5,195,803 | A | | 3/1993 | Quintile |
| 5,209,509 | A | | 5/1993 | Gay et al. |
| 5,219,204 | A | | 6/1993 | Bathrick et al. |
| 5,259,664 | A | | 11/1993 | Cottle |
| 5,297,021 | A | * | 3/1994 | Koerlin et al. ..... 364/167.01 |
| 5,320,412 | A | | 6/1994 | Eakins et al. |
| 5,352,020 | A | * | 10/1994 | Wade et al. |
| 5,542,744 | A | * | 8/1996 | Bathrick ..... 297/362.11 |
| 5,556,157 | A | | 9/1996 | Wempe |
| 5,673,967 | A | * | 10/1997 | Wempe ..... 297/68 |
| 6,036,268 | A | * | 3/2000 | Larson |
| 6,158,810 | A | | 12/2000 | Galloway |
| 6,409,265 | B1 | * | 6/2002 | Koerlin et al. |

* cited by examiner

*Primary Examiner*—Anne Marie Boehler
(74) *Attorney, Agent, or Firm*—Brett Trout

(57) ABSTRACT

An improved wheelchair leg rest extension system. The system includes a ball screw assembly provided within a steel sleeve of the wheelchair frame, and actuated by an electric motor to raise and lower a leg rest, while protecting the ball screw assembly from damage, and reducing the unsightliness and potential for damage associated with external extension and retraction means.

19 Claims, 8 Drawing Sheets

LEG EXTENSION ASSEMBLY

BACKGROUND OF THE INVENTION

1. Field of the Invention

This invention relates to a leg extension system for wheelchairs and, more specifically, to an internally contained leg extension system.

2. Description of the Prior Art

It is known in the art to provide either a powered or manual articulating leg rest for a wheelchair. An example of such a device is described in U.S. Pat. No. 5,556,157 to Wempe. Wempe describes a powered system that articulates a pair of leg rests.

One of the problems associated with prior art leg extension systems is the external placement of linkages used to extend and retract the wheelchair legs. Exposure of these linkages can lead to damage or premature wear if external elements come into contact with the linkages. More importantly, such external linkages can lead to personal injury, if a digit or limb is unintentionally exposed to the linkages as they are extended or retracted.

Another problem associated with prior art systems is the coupling of the extension system to a chair back tilt apparatus. While such a combination is often advantageous, in many situations the operator desires to operate the extension system independently of the tilting of the chair back. The linkages in such prior art systems prevent such independent operation.

For the foregoing reasons, it would be desirable to provide an articulated leg extension system for a wheelchair with internally contained extension and retraction means to shield the system from damage, to allow independent operation of the extension system and to prevent personal injury from exposure to external linkages. The difficulties encountered in the prior art discussed hereinabove are substantially eliminated by the present invention.

SUMMARY OF THE INVENTION

In an advantage provided by this invention, a wheelchair leg extension and retraction system is provided which shields the extension and retraction assembly from damage;

Advantageously, this invention provides shielding of a wheelchair's leg extension retraction system from contact with a user to reduce the occurrence of personal injury;

Advantageously, this invention provides a wheelchair leg extension and retraction system which reduces mechanical clutter on the wheelchair;

Advantageously, this invention provides a wheelchair's leg extension retraction system to operate independently of the chair back tilt mechanism;

Advantageously, this invention provides a self-contained leg extension and retraction system for a wheelchair which can be adapted to provide a shock absorption means for prevention of damage to the system;

Advantageously, in a preferred example of this invention, an improved wheelchair leg rest extension apparatus is provided, comprising a frame and an extensible member received by the frame. A leg rest is operably coupled to the extensible member and means are coupled to the extensible member for extending and retracting the extensible member. Means are also provided within the frame, and operably coupled to the extensible member, for moving the extensible member relative to the frame.

In the preferred embodiment, the extensible member is a screw and sleeve, received by a frame tube of the frame. Means are provided for rotating the screw in a manner which extends the sleeve and rotates the leg rest into an extension or retraction position in response thereto.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figures 1, 2:
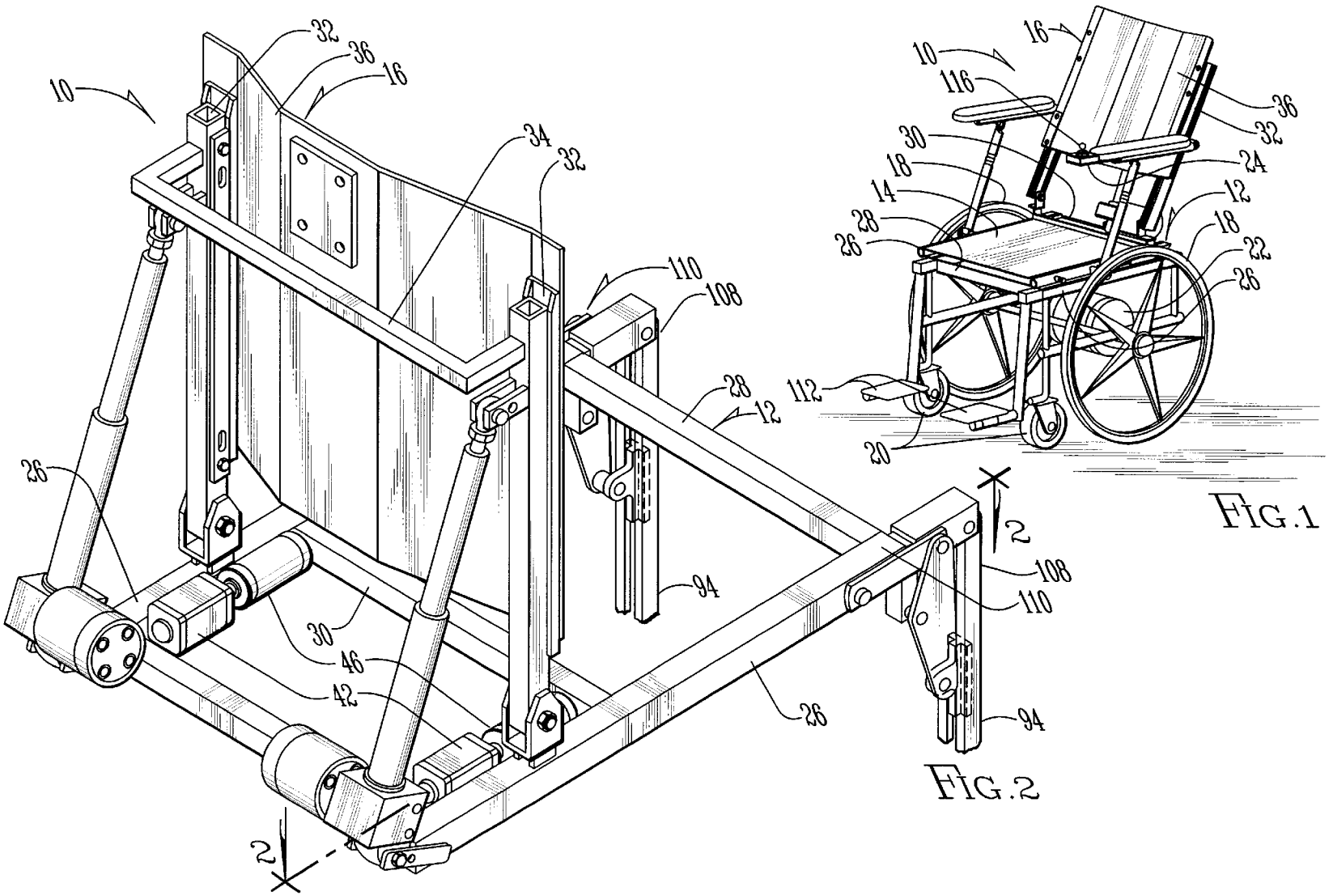
FIG. 1 illustrates a perspective view of the improved wheelchair of the present invention.
FIG. 2 illustrates a perspective view of the seatback and seatback frame, and leg extension assembly of the wheelchair of FIG. 1.
Figure 3:
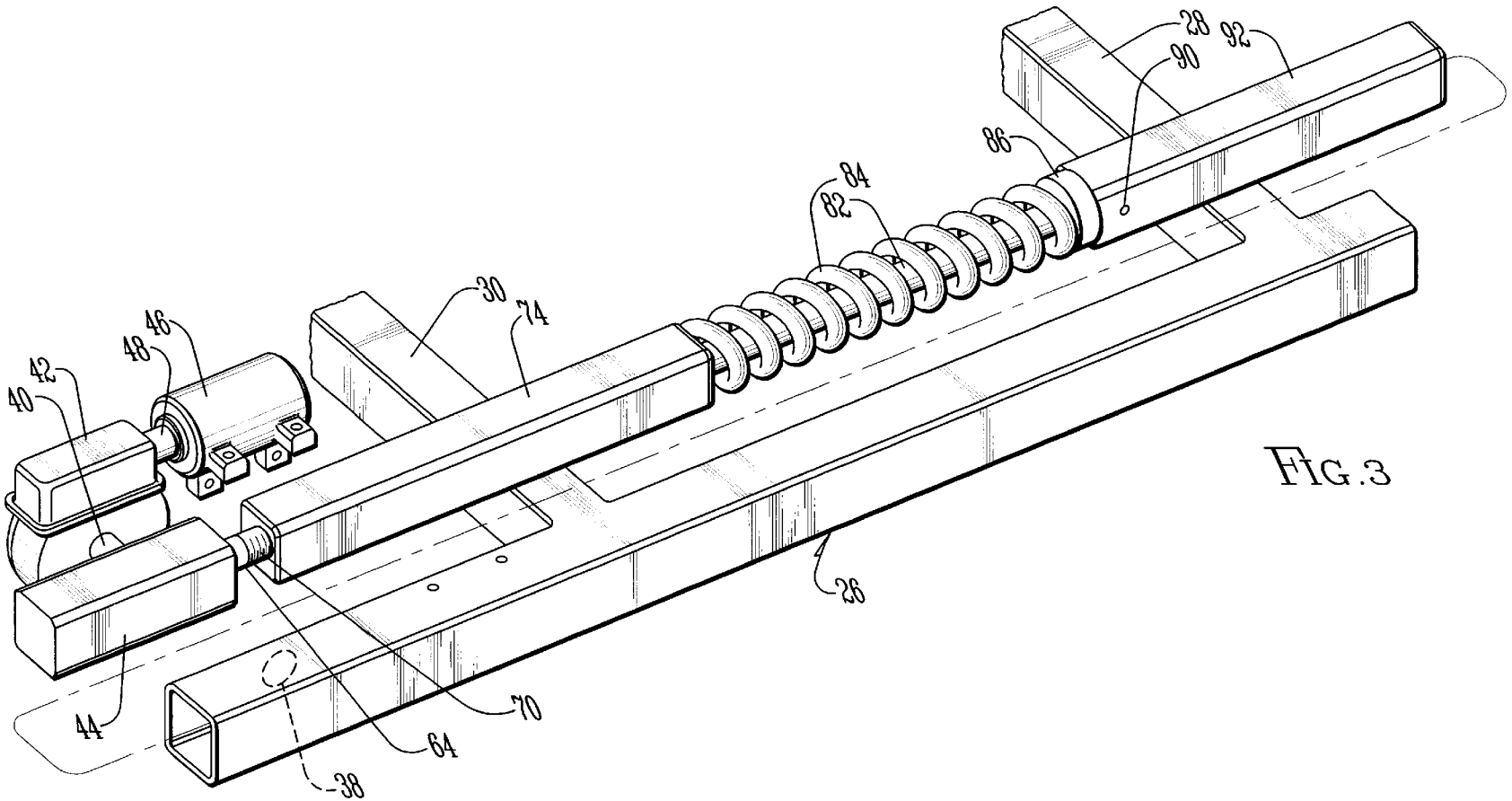
FIG. 3 illustrates a top perspective view of the extension assembly of the present invention and the sleeve.

With reference to the drawings, an improved wheelchair is shown generally as (10) in FIG. 1. The wheelchair (10) includes a frame (12), a seat (14), a back (16), a pair of rear wheels (18), and a pair of front wheels (20), such as those generally known in the art. The wheelchair (10) also includes a power supply (22), secured to the frame (12) and coupled to a control box (24). In the preferred embodiment, the power supply (22) is a twenty-four volt battery such as those known in the art. As shown in FIGS. 1 and 2, the frame (12) comprises a pair of steel sleeves (26), interconnected by a forward cross-member (28), and a rearward cross-member (30), which transfer the weight of a user to the wheels (18) and (20). Pivotally connected to the weight supporting steel sleeves (26) is a pair of back support members (32). The back (16) comprises the pair of back support members (32), a support bracket (34), and a backrest (36). As shown in FIG. 3, the steel sleeves (26) are provided with a cutout (38), through which passes a drive shaft (40), coupling a gear reduction box (42) to a right angle gearbox (44). Although this description is limited to description of a single sleeve (26), both sleeves (26) are similarly constructed, albeit in mirror image of one another. The gear reduction box (42) is, in turn, coupled to an electric motor (46) by a drive shaft (48).

Figure 4A:
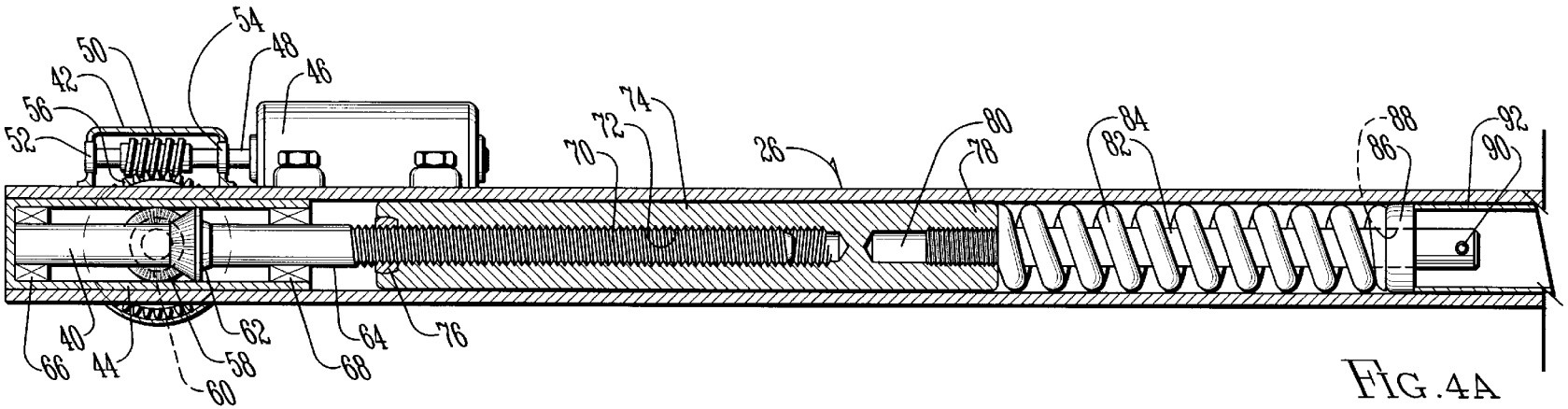
FIGS. 4A–4B illustrates a side view in cross-section, taken along line 2—2 of FIG. 2 of the improved leg extension system of the present invention, showing the leg in the upright position.
Figure 4B:
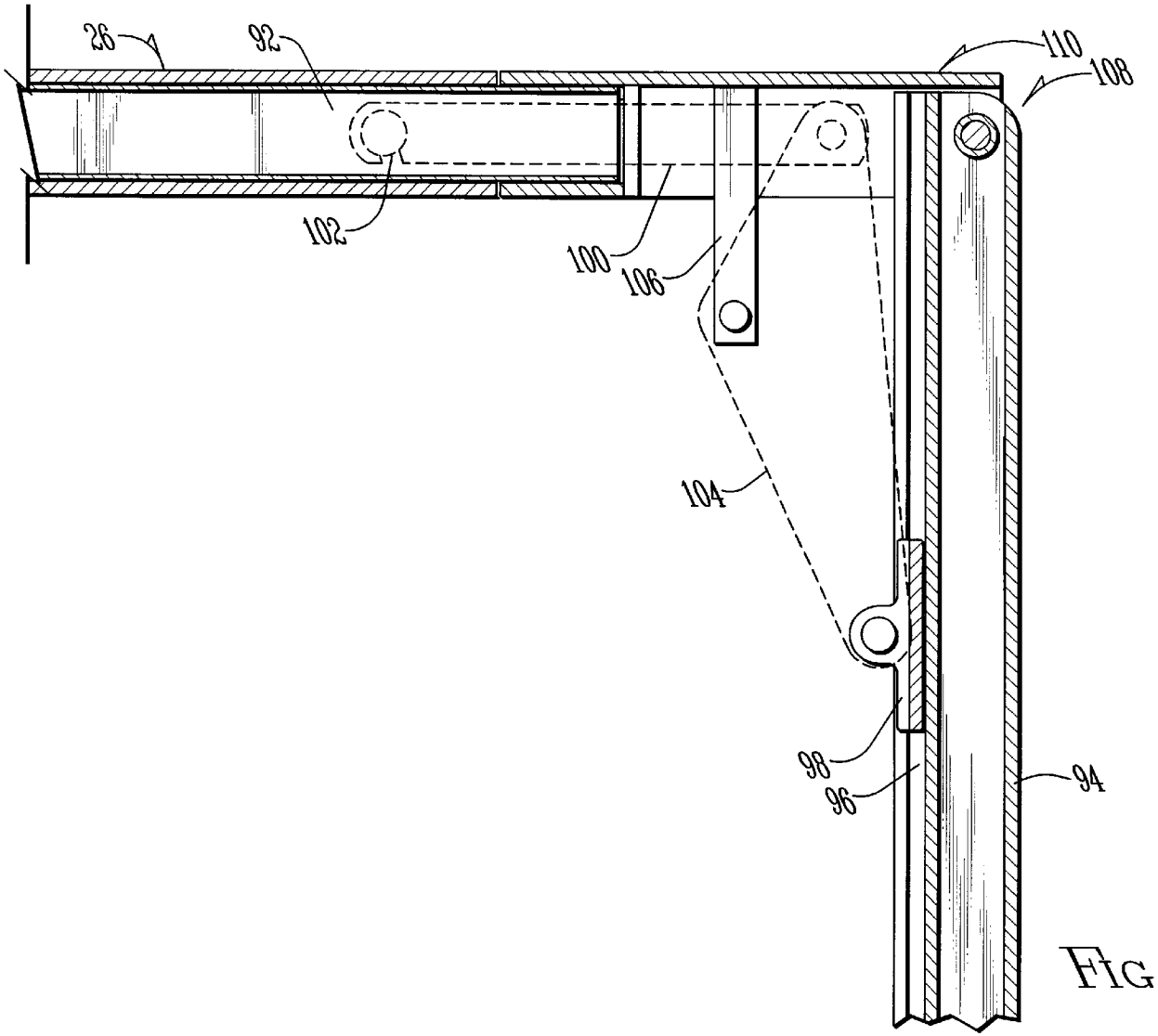

As shown in FIGS. 4A–4B, the drive shaft (48) is provided with a worm gear (50), operably coupled to a toothed wheel (52). The worm gear (50) and toothed wheel (52) are preferably designed to facilitate a forty-to-one gear reduction between the speed of the drive shaft (48) and the speed of the drive shaft (40). The gear reduction box (42) is provided with a bearing (54) and bushing (56), such as those known in the art, to reduce the loss of energy through friction, as energy is transferred between the worm gear (50) and toothed wheel (52).

Also, as shown in FIGS. 4A–4B, the drive shaft (40) is coupled to a first beveled gear (58), which may be constructed out of hardened stainless steel, brass, plastic, or any other suitable material. The drive shaft (40) is coupled to the right angle gear box (44) by a bearing (60). Coupled into mated engagement with the first beveled gear (58) within the right angle gear box (44) is a second beveled gear (62). Obviously, with any coupling between beveled gears, the connection between the first beveled gear (58) and second beveled gear (62) must be precise, to reduce the wear and friction associated with translation of rotational energy from the drive shaft (40) to a screw shaft (64), coupled to the second beveled gear (62). As shown in FIGS. 4A–4B, the screw shaft (64) is coupled to the right angle gear box (44) by a bushing (66) and bearing (68).

The screw shaft (64) is provided around its exterior with threads (70), which fit into mated engagement with a threaded interior (72) of an extension sleeve (74) provided around the screw shaft (64). In the preferred embodiment, the screw shaft (64) and extension sleeve (74) are preferably constructed of hardened steel, or similar wear-resistant and compression-resistant material. The thread (70) and threaded interior (72) are preferably designed for extension of 0.318 centimeters per revolution. The screw is preferably provided with an outer diameter of 0.841 centimeters and a root diameter of 0.711 centimeters. The outer diameter of the extension sleeve (74) is preferably 1.59 centimeters.

As shown in FIGS. 4A–4B, provided around the screw shaft (64) is an epicyclic ball screw (76), with integral freewheeling at stroke ends to eliminate the need for limit switches. The epicyclic ball screw (76) is provided to cause the extension sleeve (74) to "free wheel" relative to the screw shaft (64) when the leg rest (94) has been fully extended or fully retracted. The use of this ball screw (76) eliminates the need for limit switches, while still preventing damage to the wheelchair (10) associated with over extension or retraction of the leg rest (94). Although the above-described elements may be of any suitable construction known in the art, in the preferred embodiment, the electric motor (46), screw shaft (64), extension sleeve (74) and ball screw (76) are of a type associated with ball drive actuators, Model Nos. 85615-85616, manufactured by Motion Systems Corporation of Eatontown, N.J. In the preferred embodiment, the gear reduction box (42) of the Motion System ball drive actuator is disconnected from the screw shaft (64), and a right angle gear box (44) such as that described above is inserted between the gear reduction box (42) and the screw shaft (64), to allow the electric motor (46) and gear reduction box (42) to be mounted externally of the steel sleeves (26). In the preferred embodiment, this arrangement produces 100 pounds of thrust, and is capable of supporting a static load of 600 pounds. It should be obvious to one of ordinary skill in the art, that the components can be modified along with the gear ratios to provide more thrust, faster extension, or both, as required. By providing the separate electric motor (46) the extension sleeve (74) can be extended and retracted independent of the back (16) of the wheelchair (10), As shown in FIGS. 4A–4B, the extension sleeve (74) is integrally formed with a cap (78) provided with a bore (80). A rod (82) is secured, by threaded connection or similar attachment means, into the bore (80). Provided around the rod (82) is a spring (84). The spring is preferably steel and may be provided with any suitable tension. Alternatively, a plurality, typically ten to twenty, of conical style spring washers, known in the art as Belleville washers, may be positioned around the rod (82) instead of a standard spring (84). The rod (82) extends through a stop (86) provided with a hole (88). A pin (90) is secured through the rod (82), to prevent the rod (82) from becoming inadvertently dislodged from the stop (86). Preferably the spring (84) is maintained under tension to prevent the stop (86) from undesired movement relative to the cap (78). The stop (86) is secured to a telescoping linkage (92), provided within the steel sleeve (26). As shown in FIGS. 4A–4B, a leg rest (94) of the wheelchair (10) is formed with a slot (96) having a T-shaped cross-section. A slidable attachment ear (98) is slidably received within the slot (96) of the leg rest (94). A linkage (100) is provided with a U-shaped slot, which is releasably secured around a bolt (102) provided on the sleeve (26) to pivotally secure the linkage (100) to the sleeve (26).

A triangular pivot plate (104) is pivotally secured to the ear (98), a fulcrum (106), and the linkage (100). The dimensions of the triangular pivot plate (104) may be manipulated in conjunction with the dimensions of the fulcrum (106) and linkage (100), to raise and lower the leg rest (94) as much or as little as desired. In the preferred embodiment, the pivot plate (104), linkage (100) and fulcrum (106) do not extend beyond the top of the telescoping linkage (92), thereby allowing the pivot point of a user's leg (not shown) to be positioned closer to the pivot point of the leg rest (94). This proximity of pivot points reduces shear on the user's leg as the leg rest (94) is raised and lowered.

As shown in FIGS. 4A–4B, the fulcrum (106) is secured to a portion of the telescoping linkage (92) comprising a knee joint assembly (108). The knee joint assembly (108) is provided over the end (110) of the telescoping linkage (92) and held in place by a detent (not shown). The knee joint assembly (108) is pivotally secured to the leg rest (94). If it is desired to remove the leg rest (94), the linkage (100) is lifted from the bolt (102) and the knee joint assembly (108) is slid off of the end (110) of the telescoping linkage (92). Removal of the leg rest (94) facilitates transfer of the user to and from the seat (14) by preventing interference from the leg rest (94), and devices attached thereto.

As shown in FIGS. 4A–4B, when the telescoping linkage (92) is retracted within the sleeve (26), there is a small amount of space between the knee joint assembly (108) and the end of the sleeve (26). Accordingly, when a footrest (112) of the leg rest (94) contacts a door or wall (not shown) and pressure is exerted against the knee joint assembly (108), the force is absorbed by the spring (84) rather than directly by the cap (78) and ball screw assembly (114). (FIGS. 1 and 4). As the telescoping linkage (92) moves rearward, pressure is transferred onto the stop (86) and onto the spring (84). The rod (82) remains relatively stationary until the force is removed. As the force is withdrawn, the spring (84) forces the stop (86) and telescoping linkage (92) forward into its original position.

Figure 5A:
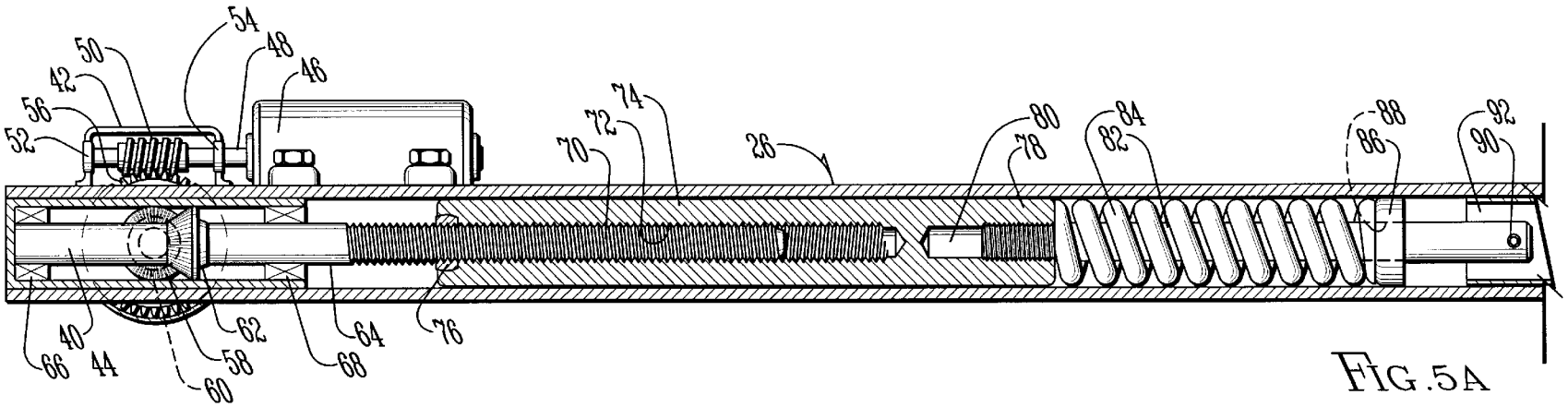
FIGS. 5A–5B illustrates a side view in cross-section of the improved leg extension system of FIGS. 4A–4B, showing the leg in the extended position.
Figure 5B:
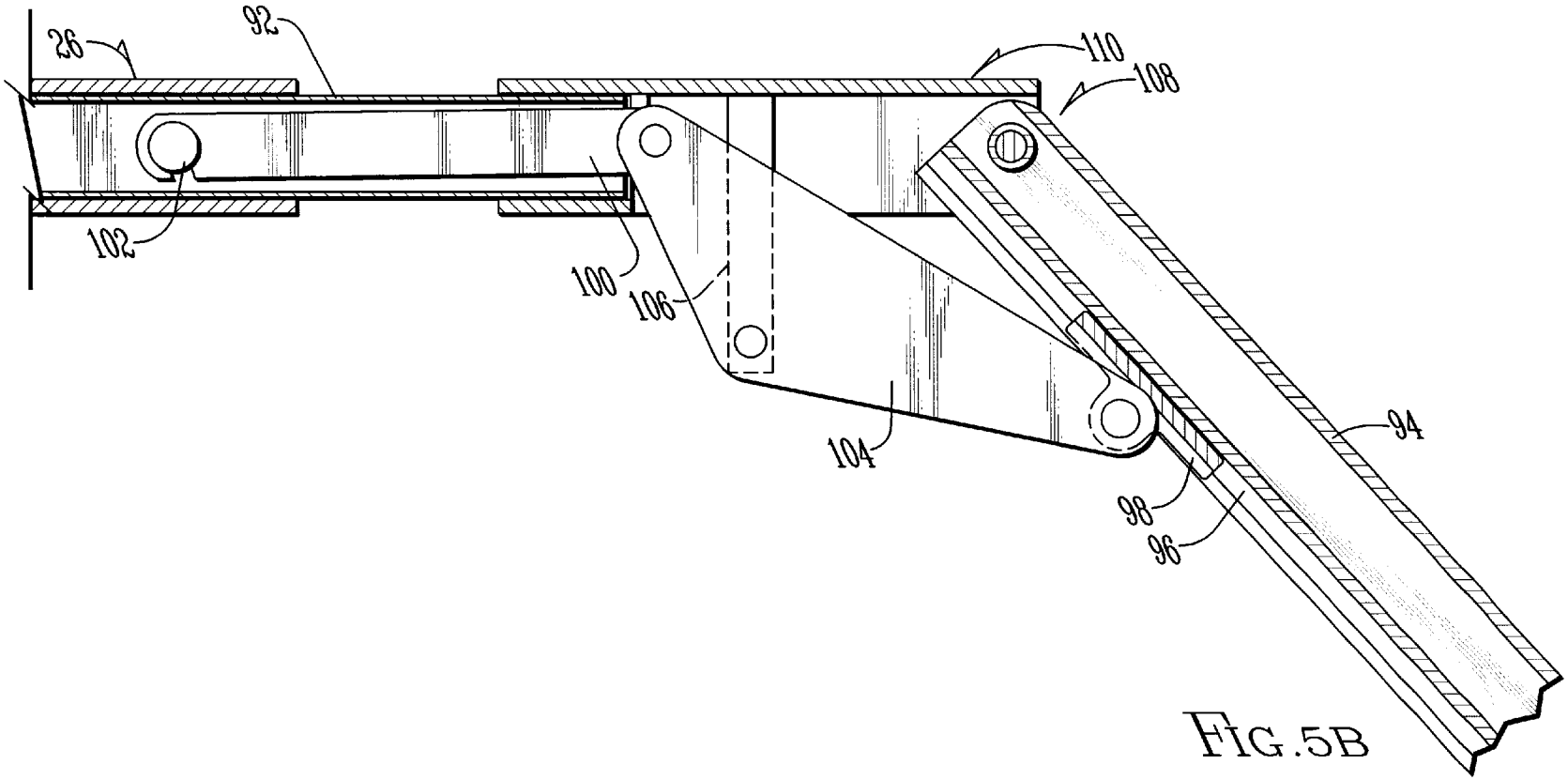

As shown in FIGS. 2 and 5, when it is desired to raise the leg rest (94), a user manipulates a control button (116) located on the control box (24). This provides power from the power supply (22) to the electric motor (46) to actuate the worm gear (50) to rotate the toothed wheel (52). The toothed wheel turns the beveled gears (58) and (62) and rotates the screw shaft (64). As the screw shaft (64) rotates, the threads (70) contact the threaded interior (72) of the extension sleeve (74), thereby extending the extension sleeve and cap (78). As the cap (78) extends, the cap presses against the spring (84), forcing the stop (86) and telescoping linkage (92) attached thereto outward from the sleeve (26). As the telescoping linkage (92) extends, the fulcrum (106) moves forward, rotating the pivot plate (104). As the pivot plate (104) rotates relative to the linkage (100), the lower end of the pivot plate (104) rotates upward, forcing the ear (98) upward along the slot (96), and forcing the leg rest (94) upward.

Even in this extended position, the spring (84) absorbs shock to the leg rest (94) and prevents damage to the ball screw assembly (114). When the leg rest (94) is subjected to a shock or force such as a wall or door striking the leg rest (94), the force is transmitted from the leg rest (94) to the telescoping linkage (92) into the stop (86), and thereafter into the spring (84). As the force moves the telescoping linkage (92) rearward, the stop (86) compresses the spring (84) against the cap (78) until the force of the spring (84) overcomes the force on the leg rest (94). As the force on the leg rest (94) is removed, the spring (84) expands to its original position. By absorbing the shock with the spring (84), defamation and damage of the leg rest (94), telescoping linkage (92) and ball screw assembly (114) are substantially eliminated.

When it is desired to lower the leg rest (94), the control button (116) on the control box (24) is actuated to reverse the rotation of the electric motor (46). This, in turn, reverses rotation of the worm gear (50) and toothed wheel (52). This reverses the rotation of the first beveled gear (58) and second beveled gear (62) to reverse rotation of the screw shaft (64), thereby retracting the telescoping linkage (92) and moving the fulcrum (106) rearward, rotating the pivot plate (104). As the pivot plate (104) rotates relative to the linkage (100), the lower end of the pivot plate (104) rotates downward. This forces the ear (98) downward along the slot (96), and allowing the leg rest (94) to pivot downward. By locating the ball screw assembly (114) within the sleeves (26), the wheelchair (10) has a less cluttered appearance, allows for the attachment of additional items to the wheelchair, and protects the ball screw assembly (114) from damage due to direct shock or contact with corrosive material. Locating the ball screw assemblies (114) within the sleeves also reduces the risk of personal injury associated with exposed linkages.

Figure 6:
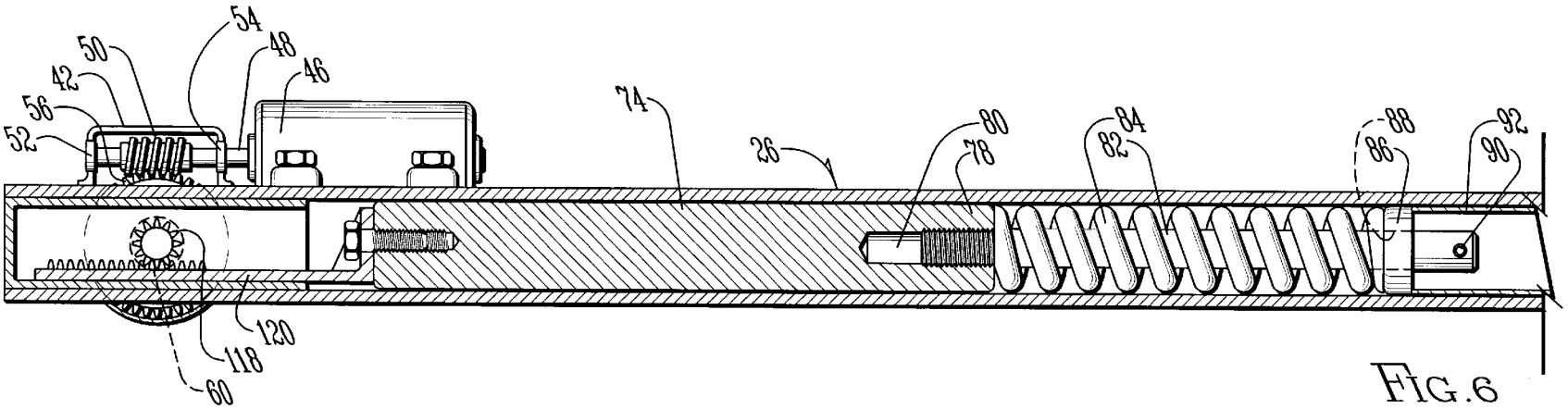
FIG. 6 illustrates a side view in partial cross-section of an alternative embodiment of the present invention, utilizing a rack and pinion.
Figure 7:
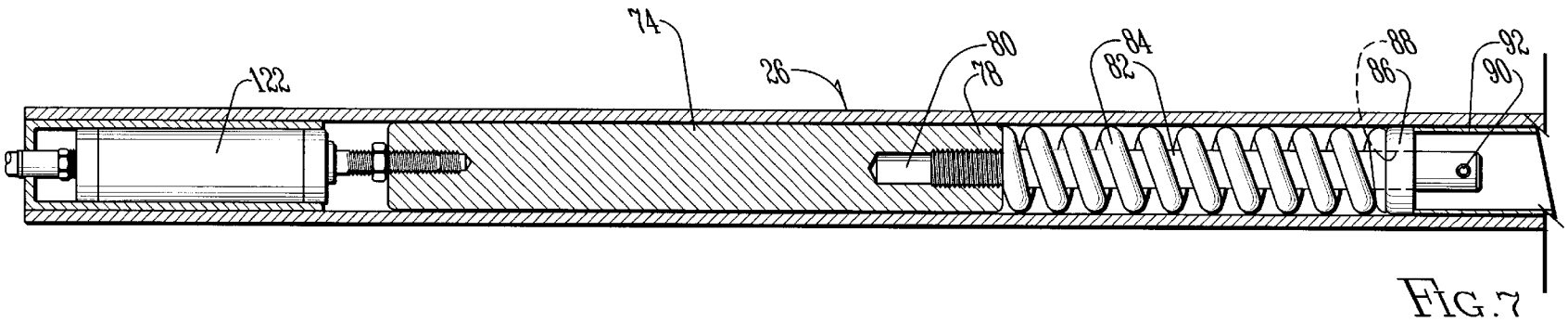
FIG. 7 illustrates a side view in partial cross-section of an alternative embodiment of the present invention, utilizing a fluid piston.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. For example, it is anticipated that the ball screw assembly (114) of the present invention may be utilized with any suitable elevating leg rest mechanism known in the art. It is also anticipated that sheaves and a belt may be used to replace the beveled gears described above to translate rotational energy from the motor to the ball screw assembly (114). Alternatively, the electric motor (46) may be mounted parallel to the ball screw assembly (114) through the provision of a small hole in the end of the sleeve (26), or the electric motor (46) may be reduced in size and provided directly within the sleeve (26) itself. In another alternative embodiment, as shown in FIG. 6, the first beveled gear (58) is replaced with a pinion (118) and the ball screw assembly (114) is replaced with a rack (120). In yet another alternative embodiment of the present invention, a fluid piston (122), such as that shown in FIG. 7, which may be either hydraulic or pneumatic, may be provided within the sleeve (26) to actuate the leg rest (94).

What is claimed is:

1. An improved wheelchair leg rest extension apparatus, comprising:

(a) a frame, including a frame tube;

(b) an extensible member operably received within said frame tube;

(c) a leg rest operably coupled to said extensible member;

(d) means coupled to said extensible member for extending and retracting said extensible member; and (e) means provided within said frame and operably coupled to said extensible member for moving said extensible member relative to said frame.

2. The improved wheelchair leg rest extension apparatus of claim 1, including means for rotating said moving means.

3. The improved wheelchair leg rest extension apparatus of claim 2, wherein said rotating means is provided within said frame.

4. The improved wheelchair leg rest extension apparatus of claim 1, further comprising means operably coupled to said leg rest for absorbing shock force applied to said leg rest.

5. The improved wheelchair leg rest extension apparatus of claim 4, wherein said absorbing means is resilient means secured between said frame and said leg rest for allowing said leg rest to move from a starting position relative to said frame and means for biasing said leg rest back to said starting position.

6. The improved wheelchair leg rest extension apparatus of claim 4, wherein said absorbing means is a spring.

7. The improved wheelchair leg rest extension apparatus of claim 1, wherein said leg rest is pivotally connected to said extensible member.

8. The improved wheelchair leg rest extension apparatus of claim 7, further comprising means for pivoting said leg rest in a first direction upon extension of said extensible member and for pivoting said let rest in a second direction upon retraction of said extensible member.

9. The improved wheelchair leg rest extension apparatus of claim 1, wherein said moving means is operably received within said frame tube.

10. The improved wheelchair leg pest extension apparatus of claim 1, wherein said moving means is a ball screw.

11. The improved wheelchair leg rest extension apparatus of claim 10, further comprising a motor coupled to said ball screw.

12. The improved wheelchair leg rest extension apparatus of claim 11, further comprising a first gear coupled to said ball screw and a second gear coupled to said motor and into driving communication with said motor.

13. The improved wheelchair leg rest extension apparatus of claim 12, wherein said first gear and said second gear are bevel gears.

14. An improved wheelchair leg rest extension apparatus comprising:

(a) a frame having a frame tube;

(b) a screw received by said frame tube;

(c) a leg rest operably coupled to said screw; and (d) means for rotating said screw in a manner which rotates said leg rest in response to rotation of said screw.

15. The improved wheelchair leg rest extension apparatus of claim 14, further comprising means operably coupled to said leg rest for absorbing shock force applied to said leg rest.

16. The improved wheelchair leg rest extension apparatus of claim 15, wherein said absorbing means is resilient means operably coupled to said screw for allowing said leg rest to move from a starting position relative to said frame and means for biasing said leg rest back to said starting position.

17. The improved wheelchair leg rest extension apparatus of claim 16, wherein said absorbing means is a spring.

18. The improved wheelchair leg rest extension apparatus of claim 14, further comprising a seat and wherein said frame tube is in a load bearing relationship relative to said seat.

19. An improved wheelchair comprising:

(a) a seat;

(b) a wheel;

(c) a frame having a frame tube;

(d) wherein said frame tube is positioned for transmission of force from said seat to said wheel;

(e) a screw received by said frame tube;

(f) a leg rest operably coupled to said screw; and (g) means for rotating said screw in a manner which rotates said leg rest in response to rotation of said screw.

* * * * *